United States Patent [19]

Genini

[11] 4,298,031

[45] Nov. 3, 1981

[54] SHED FORMING DEVICE FOR LOOMS

[75] Inventor: Graziano Genini, Stabio, Switzerland

[73] Assignee: Albatex AG, Vaduz, Liechtenstein

[21] Appl. No.: 65,155

[22] Filed: Aug. 9, 1979

[30] Foreign Application Priority Data

Aug. 14, 1978 [CH] Switzerland ..... 8599/78

[51] Int. Cl.[3] ..... D03C 1/12

[52] U.S. Cl. ..... 139/55.1; 139/66 R; 139/139; 139/76

[58] Field of Search ..... 139/55.1, 66 R, 76, 139/77, 78, 79, 80, 455

[56] References Cited

U.S. PATENT DOCUMENTS

| | | | |
|---|---|---|---|
| 3,192,957 | 7/1965 | O'Neill | 139/66 R |
| 3,724,510 | 4/1973 | Kleiner | 139/66 R |
| 3,804,128 | 4/1974 | Amigues | 139/66 R |
| 3,807,460 | 4/1974 | Alexandr et al. | 139/76 |
| 3,889,720 | 6/1975 | Porter | 139/66 R |

*Primary Examiner*—Henry Jaudon

*Attorney, Agent, or Firm*—Young & Thompson

[57] ABSTRACT

Shed forming device for looms of the type having members (1) operated by a common rotating drive shaft (9) and linkages (2, 4, 6) controlled by the members (1) to move the heald frames. Between the drive shaft (9) and each of the members (1) there is interposed a clutch controlled by the fabric pattern model or paper by per se known, structure, by which clutch the position of the member (1) can be released from the movement of the shaft (9).

7 Claims, 9 Drawing Figures

SHED FORMING DEVICE FOR LOOMS

BACKGROUND OF THE INVENTION

In the art of weaving machines many devices are known by which the shed formation is carried out, i.e. the heald frames for looms are cyclically moved to the desired positions to provide a certain predetermined pattern of the fabric being worked out.

In all these devices, mechanical reciprocating members are provided which, operated by a rotating drive shaft, cause the heald frames to move between two working positions, namely top and bottom positions, by laws that in all the presently existing devices are strictly cyclically established for each frame. Thus, it occurs that when the fabric pattern has to be changed, said mechanical members must be operated on by adjustments, registrations, replacement of parts, with serious disadvantages as to the continuity in production and capability thereof.

The foregoing is apparent in view of some of the most wide spread designs of shed forming devices, such as the one comprising a pack of cams which by means of oscillating feeling roller levers transmit suitable movements to the heald frames. In such a device, when it is desired to change the sequence of movements for the heald frames, the pack of cams has to be each time changed, which is a rather substantial expense for the weaver, who is obliged to store a large supply of different cams to provide for all the desired dobbies.

Similar drawbacks also occur with another type of shed forming device, that is the eccentric type of device, the use of which is particularly suitable for taffeta weaving. Instead of the conventional knives, this device has circular eccentrics having rocking connecting rods mounted thereon, so as to convert the rotary motion of the shaft into a reciprocating motion of the heald frames through suitable linkages. Also these devices are unsuited (and accordingly have not been hitherto adopted) for shed formation in fabrics of any pattern owing to the drawback that in each cycle the movement of each heald frame between either of two alternate positions is to be always provided. On the other hand, up to now devices were not known for causing a smooth and fast release or restraint according to predetermined requirements of the individual eccentrics to the motion of the drive shaft, so as to vary the position of the heald frames, as desired.

This occurs also in the case of a third type of shed forming devices, that is devices comprising a polycentrical cam and a pair of opposing feeling rollers guided on straight slides, one of which controls the heald frame.

SUMMARY OF THE INVENTION

The object of the present invention is to remove the strict bond between the cycle of rotation for the drive shaft of all these devices and the positions strictly resulting therefrom of the mechanisms of such devices and accordingly of the heald frames, so as to provide wide possibilities of accomodation to the increasingly varied requirements in the production of fabrics having even very different patterns without having to resort to long and complicated replacement and setting up operations. In other words the invention purposes to provide highly effective and accurate shed forming devices having a very high flexibility of accomodation to any weaver's requirements.

The invention accomplishes this object by interposing between the drive shaft of the shed forming device and the member of this device, which is operated by the same shaft to drive the heald frames, a clutch which is controlled through known means by the fabric pattern model, by which the position of said member can be released from the drive of said shaft. In practice, when at rest position said clutch will allow the normal operation of the member by the shaft, while locking when operated said member at a fixed position during the normal rotation of the shaft. For an efficient operation of the clutch according to the invention, the drive shaft will not be continuously moved as in conventional machines, but will be intermittently moved, for example, by means of an intermitting member. It is understood that the connection and disconnection of the clutch will occur during pauses of said intermittent motion of the drive shaft.

Preferably, such a clutch interposed between the drive shaft and member of the shed forming device thereby operated has a sleeve or bush integral with said shaft, on which said member is rotably mounted. Said sleeve or bush terminates with an end projecting flange provided at its periphery with a splined profile, and said member has an extension placed side-by-side to said flange which has the same diameter and carries an identical splined profile. The above clutch has a clutch ring which on its internal periphery a splined profile complementary to that of said flange and extension, for sliding according to the shaft axis on said flange and extension and for rotating therewith, and a drive ring fixed against rotation, but movable according to said axis, for causing said clutch ring to move and engaging said member by blocking the rotation thereof.

BRIEF DESCRIPTION OF THE DRAWINGS

The invention will now be herein-after described in further detail with reference to three preferred embodiments thereof, corresponding to its application in the above outlined three types of shed forming device for looms. It is a matter of a merely exemplary description which is given with the aid of the accompanying drawings, in which.

DESCRIPTION OF THE PREFERRED EMBODIMENTS

Figure 1:
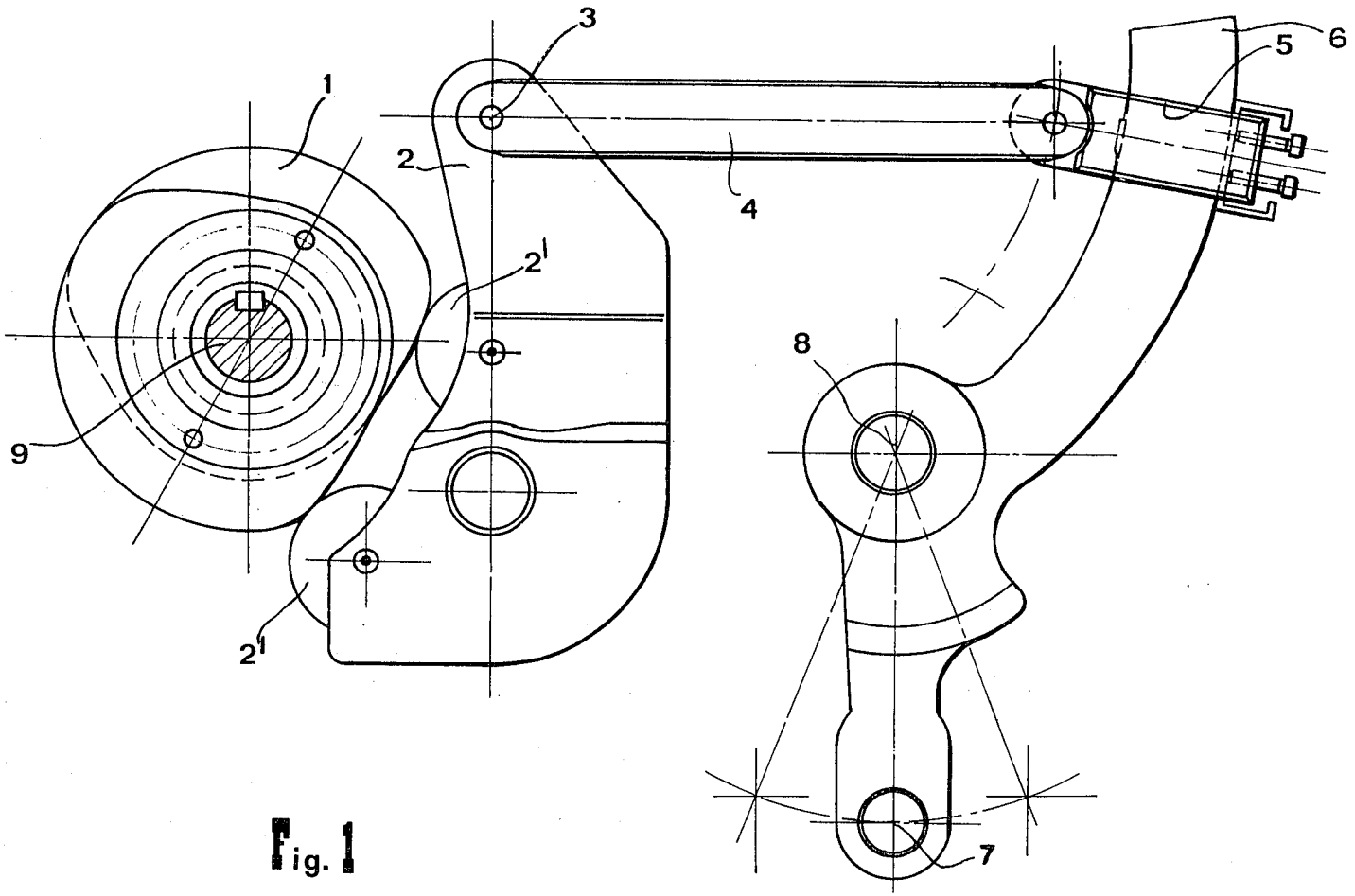
FIG. 1 is a general schematic view showing a first embodiment of the device according to the invention.
Figure 2:
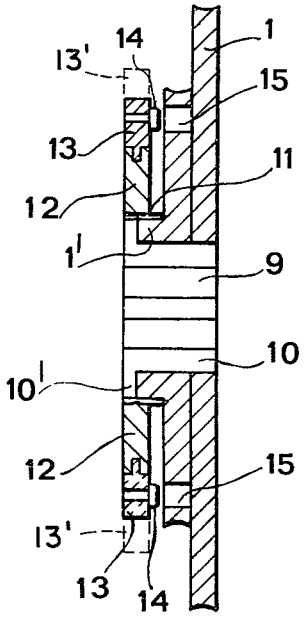
FIGS. 2 and 3 are sectional views showing the clutch as applied to the device of FIG. 1 under rest and operative conditions, respectively.
Figure 3:
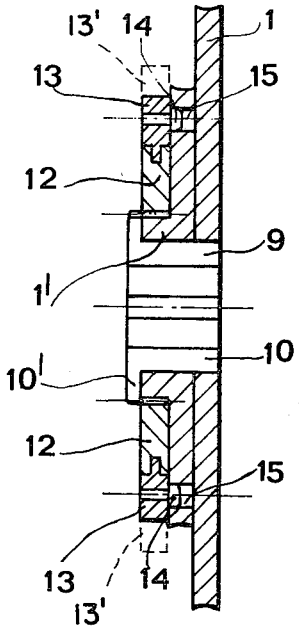

First referring to FIGS. 1 to 3, a device for shed formation in a loom according to the invention comprises a plurality of mechanical units, such as the one shown in FIG. 1, each formed of a double conjugate race cam 1, a rocking lever 2 having feeling rollers 2' (to the angular rotation of cam 1 corresponds a different angular rotation of roller lever 2 and on rotation of lever 2, the pin 3 moves through a well defined arc), and a connecting rod 4, by means of which the movement of pin 3 is transmitted through a clamp 5 to a registering lever 6.

Thus, the pin 7 of lever 6 can be moved through any arc in the range of maximum and minimum values depending on whether said clamp 5 is closer to or farther from the center of oscillation 8 of the lever.

The devices uses double-race cams of the single type for "taffeta" dobbies (that is cams for providing the so-called "taffeta movement", according to which the position of the heald frames is alternatively high and low for successive blows of the loom).

Each of the double-race cams 1 is mounted on the operating shaft 9—which for reasons to be better explained hereinafter is an intermittently rotating shaft—by means of a sleeve or bush 10 keyed to said shaft and terminating at its end externally of the cam with a projecting flange 10' on which a splined profile 11 is formed. Said cam 1—which is freely rotable on sleeve or bush 10—has an axial extension 1' of the same diameter as that of the sleeve flange 10' and also provided with an identical splined profile 11. The arrangement is completed by a clutch ring 12, the inner side of which carries a splined profile 11 complementary to the preceding ones and suitable to engage therewith, and the outer side of which can be axially translated, but not rotated, by a drive ring 13 that is fixed against rotation, ring 12 being free to rotate without ring 13. The side of ring 13 facing said cam 1 has projecting clutch pins 14 for front engagement with holes 15 in said cam 1.

Under the conditions of FIG. 2, wherein the clutch is at rest position, the drive ring 13 holds the clutch ring 12 with its own splined profile in engagement with both the complementary profiles of flange 10 and cam 1 which are thus made integral for rotation. Therefore, under this condition, said cam 1 is caused to rotate when shaft 9 rotates. On the other hand, when by a suitable control 13' the ring 13 is moved to cam 1, the clutch will take the active position of FIG. 3: the pins 14 penetrate into holes 15, and at the same time the splined profile of the clutch ring 12 engages only the profile of the extension 1' of cam 1. Thus this latter may remain stationary at the position at which the engagement of pins 14 with holes 15 has occurred, while shaft 9 goes on rotating until ring 13 has moved ring 12 back to the position of FIG. 2.

Thus, the high or low position of the individual heald frames may be maintained for the desired number of cycles of the loom independently of the movement of the drive shaft and without having to replace the series of cams, but still using the same simple cams for "taffeta" dobby.

As previously mentioned, shaft 9 does not continuously move, but it is intermittently rotated. This intermittent rotation can be provided in various manners, particularly by the application of an intermitting device and—in addition to substantially improve the conditions for inserting the weft yarns into the warp—it has the purpose of allowing the operation of the clutch device according to the invention. As a matter of fact it is the stopping of shaft 9 which allows the clutch ring 12 to pass from one to the other of its positions by sliding on the splined profiles 11. The stop or pause time may be selected in any number of degrees with respect to the round angle and it depends on the desired smoothness of movement, taking into account the necessity of timing the movement sequences with the weaving requirements or demands.

The means for carrying out the movements for the drive ring 13 of the clutch have not been described, since they may be of any type or design. Of course, such means will be controlled by the fabric pattern model or paper which has to be made through any of the known feeling devices.

Figure 4:
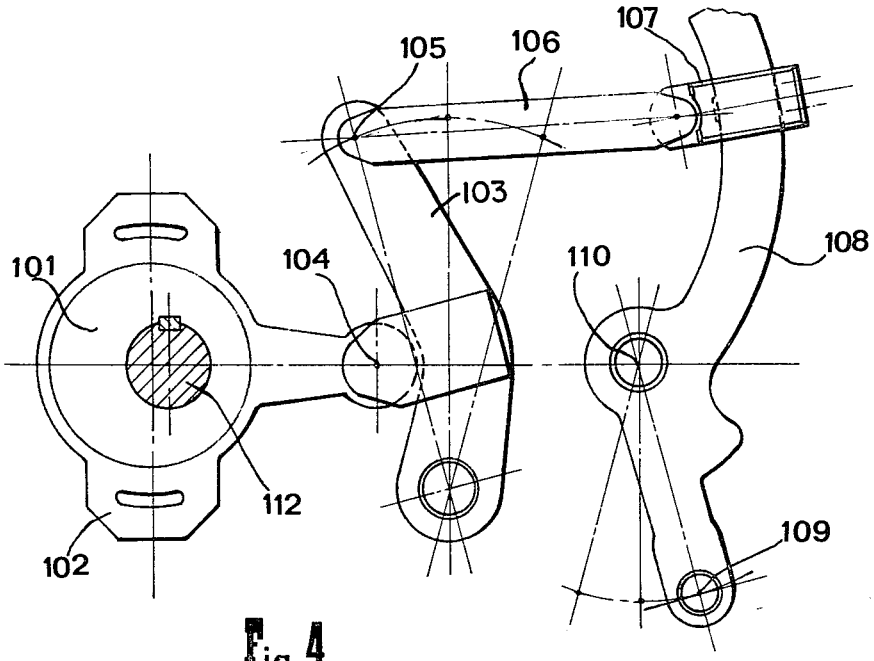
FIG. 4 is a general schematic view showing a second embodiment of the device according to the invention.
Figure 5:
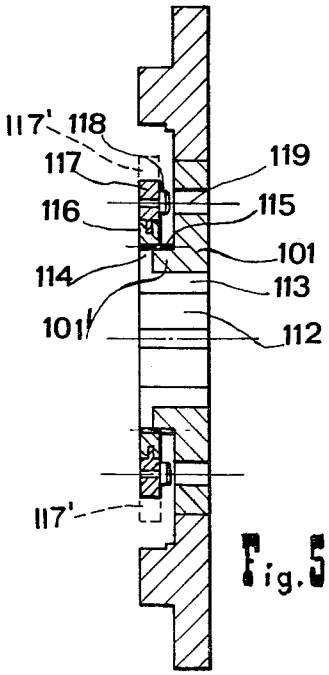
FIGS. 5 and 6 are sectional views showing the clutch as applied to the device of FIG. 4 under rest and operative conditions, respectively.
Figure 6:
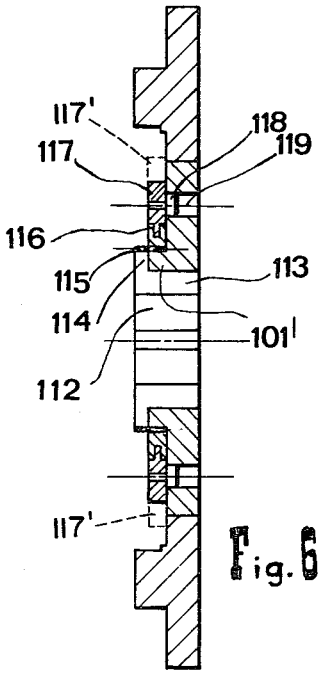

Considering now the embodiment of FIGS. 4 to 6 for the device according to the invention, also in this case there are a plurality of closely side-by-side mechanical units, such as the one shown in FIG. 4. Each of these units comprises a circular eccentric 101, a connecting rod 102 carried on the eccentric 101 and rotating therewith, and a rocking lever 103 to which said connecting rod 102 is pivoted at 104. When the eccentric 101 rotates and the connecting rod 102 oscillates, the pin 105 of lever 104 describes an arc of well defined amplitude. By means of a connecting rod 106 and clamp 107, this movement is translated to the adjusting lever 108, and the pin 109 of this lever can be caused to travel any arc of an amplitude ranging between a maximum and a minimum value, depending on whether said clamp 107 is closer to or farther from the center of oscillation 110 of said lever 108. The eccentric 101 is mounted on the operating shaft 112 just as for the cam 1 of the previously described device on shaft 9, that is through the intermediary of a sleeve or bush 113 keyed to said shaft and terminating at its end externally of the eccentric with a projecting flange 114, on which a splined profile 115 is formed. The eccentric 101, which is freely rotable on sleeve or bush 113, has an axial extension 101' of the same diameter as the sleeve or bush flange 114 and is also provided with an identical splined profile 115. The arrangement is completed by a clutch ring 116, the inner side of which carries a splined profile 115 complementary to the previous ones and suitable to engage therewith, and the outer side of which can be translated, but not rotated, by a drive ring 117 carrying on its face facing said eccentric projecting clutch pins 118 for front engagement with holes 119 provided on said eccentric 101.

Under the conditions of FIG. 4, wherein the clutch is at rest position, the drive ring 117 holds the clutch ring 116 with its own splined profile in engagement with both of the complementary profiles of the flange 10 and extension 101', which are thereby made integral in rotation. Therefore said eccentric 101 is caused to rotate when said shaft 112 rotates. On the other hand, when by means of a suitable control 117' said ring 117 is moved towards the eccentric 101, the clutch will take the active or operative position of FIG. 5: said pins 118 penetrate into the holes 119, and at the same time the splined profile of clutch ring 116 engages only the profile of the extension 101' of the eccentric 101. Thereby, this latter is allowed to stay stationary at the position at which the engagement of pins 118 with holes 119 occurred, while said shaft 112 goes on rotating until said ring 117 has moved the ring 116 back to the position of FIG. 4.

Also by this arrangement the high or low position of the individual heald frames may be maintained during the desired number of cycles of the loom by simple control of the means controlled by the fabric pattern model or paper and without having to provide for modifications, adjustments or replacements in the device for any type of dobby to be made as desired. Of course, also in this case the movement of shaft 112 is an intermittent movement (such as that provided by an intermitting device) and it is during the pauses of this movement that the activation and deactivation operation of the clutch device can be carried out.

Figures 7, 8, 9:
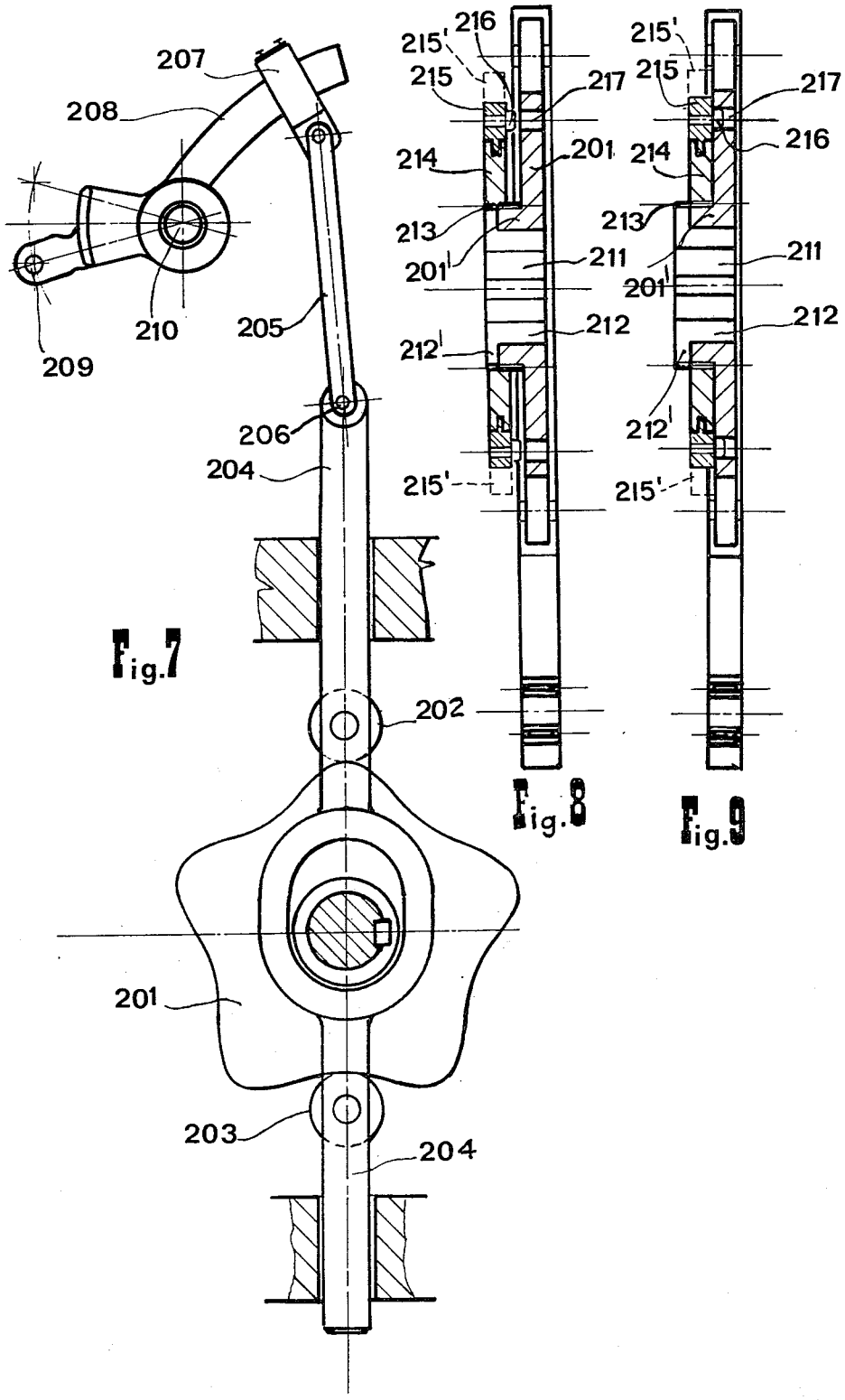
FIG. 7 is a general schematic view showing a third embodiment of the device according to the invention.
FIGS. 8 and 9 are sectional views showing the clutch as applied to the device of FIG. 7 under rest and operative conditions, respectively.

A third embodiment of the device according to the invention is shown in FIGS. 7 to 9. In this case a polycentrical cam 201 is provided, which has two opposing feeling rollers 202 and 203 engaged on its profile and mounted on a single guide slide 204 which, upon the angular rotation of the cam 201 is moved by translatory motion either in one direction or in the opposite direction. The cam 201 should have a special profile, since both the rollers engage on the same race or track. More particularly, said cam 201 has lobes at maximum diameter and depressions at minimum diameter. Should the cam be continuously connected to the intermittently rotating drive shaft, at each shedding of the loom it would have to rotate so as to cause the slide carrying the feeling rollers to effect a complete displacement or movement in only one direction. On the contrary if the heald frame is to be kept stationary, the cam must be disconnected and held stationary. Also in this case, the control is effected through a rotational movement which is converted into a reciprocation, as required by the heald movement.

When rotating, said cam 201 causes the roller carrying slide 204 to translate, the slide being pivoted to a connecting rod 205 at location 206, which location upon the rotation of cam 201 describes a section of constant and well defined amplitude. This displacement or movement is transferred to the adjusting lever 208 by means of connecting rod 205 and a clamp 207. Therefore, the pin 209 of this lever can be made to travel any arc of an amplitude ranging between a maximum and a minimum value, depending on whether said clamp 207 is closer to or farther from the center of oscillation 210 of said lever 208.

Cam 201 is carried on the operating shaft 211—which, also in this case is an intermittently rotating shaft owing, for example, to the provision of an intermitting device, by means of a sleeve or bush 212 keyed to the shaft and terminating at its end externally of the cam with a projecting flange 212', on which a splined profile 213 is formed.

Said cam 201—which is freely rotable on sleeve or bush 212—has an axial extension 201' of the same diameter as the flange 212' of the bush or sleeve and is also provided with an identical splined profile 213. The arrangement is completed by a clutch ring 214, the inner side of which carries a splined profile 213 complementary to the previous ones and suitable to engage therewith, and the outer side of which can be moved but not rotated by a drive ring 215 carrying on its face facing said cam 201 projecting clutch pins 216 for front engagement with holes 217 provided on said cam 201.

Under the conditions of FIG. 8, in which said clutch is at rest position, the drive ring 215 holds the clutch ring 214 with its own splined profile in engagement with both the complementary profiles of flange 212' and cam 201', which are thus made unitary in rotation. Therefore, under this condition said cam 201 is caused to rotate when shaft 211 is rotating. On the other hand, when by suitable control 215' said ring 215 is moved to cam 201, the clutch will take the active or operative position shown in FIG. 9. Pins 216 will penetrate into holes 217, while at the same time the splined profile of clutch ring 214 engages only the profile of extension 201' of cam 201. Thus, this latter is allowed to stay stationary at the position at which the engagement of pins 216 with holes 217 has occurred, whereas shaft 211 goes on rotating until said ring 215 has brought ring 214 back to the position of FIG. 8.

The same considerations as for the two preceding embodiments are true also for this embodiment. And in all the three embodiments, a device according to the invention is distinguished by the conveniently reduced overall sizes, for the advantageously fast and accurate and at the same time smooth operation which avoids shocks and damage to the parts comprising it, as well as by simplicity in construction and operation. The selection among the various embodiments of the device will depend on reasons of construction, operation, service and cost, more relating to the designer and user than to the merely inventive aspects of the invention.

For the same reason it is apparent that other embodiments of the device for weft shed formation according to the invention could be likewise contemplated and provided within the scope of the invention in accordance with criteria other than those of the illustrated devices, or by mere modifications thereto.

I claim:

1. In a device for carrying out shed formation in looms, of the type having members operated by a common rotating drive shaft and linkages controlled by said members to move heald frames, and a clutch interposed between said drive shaft and each of said members selectively to release said member from rotation with the drive shaft; the improvement in which said clutch comprises a sleeve fast for rotation with the drive shaft, said member being mounted for rotation on said sleeve, said sleeve having a radially outwardly projecting end flange having at its outer periphery a splined profile, said member having an axially extending flange coaxial with and of the same outer diameter as said sleeve flange, said member flange having an identical splined profile on its outer periphery as said sleeve flange, a clutch ring having on its inner periphery a splined profile adapted to mate with and slide axially on said splined profiles of said flanges, and a drive ring mounted axially slidably but non-rotatably on said clutch ring for moving said clutch ring axially between a first position in which said clutch ring bridges over and interconnects said sleeve flange and said member flange for conjoint rotation with said drive shaft, and a second position in which said splined inner periphery of said clutch ring mates only with said splined outer periphery of said member flange thereby to permit rotation of said sleeve within and relative to said member, said drive ring in said second position of said clutch ring engaging said member to prevent rotation of said member.

2. A device as in claim 1, said member and said drive ring having on one of them a projection and on the other of them a hole in which said projection is received in said second position to prevent rotation of said member.

3. A device as in claim 1, wherein said member is a double conjugate race cam having the two feeling rollers of a rocking lever engaged thereon for causing the movement of a heald frame through a connecting rod and an adjusting lever, to which said connecting rod is coupled by an adjustable clamp.

4. A device as in claim 3, wherein said double conjugate race cam is of the type for "taffeta" dobby.

5. A device as in claim 1, wherein said member is an eccentric on which the small end of a connecting rod is carried, the head of which controls the oscillation of a lever for causing the movement of a heald frame through a connecting rod and an adjusting lever, to which connecting rod is coupled by an adjustable clamp.

6. A device as in claim 1, wherein said eccentric is a circular eccentric.

7. A device as in claim 1, wherein said member is a polycentrical cam, having two opposing feeling rollers engaged on the profile thereof and mounted on a single guide slide for causing the movement of a heald frame through a connecting rod and adjusting lever, to which said connecting rod is coupled by an adjustable clamp.

* * * * *